US005493992A

United States Patent [19]

Johnson

[11] Patent Number: 5,493,992

[45] Date of Patent: Feb. 27, 1996

[54] PORTABLE DOCKS

[76] Inventor: Richard D. Johnson, 19400 Orwell Ave., Marine-On-St. Croix, Minn. 55047

[21] Appl. No.: 363,935

[22] Filed: Dec. 27, 1994

[51] Int. Cl.[6] ..... B63B 35/44

[52] U.S. Cl. ..... 114/263

[58] Field of Search ..... 114/266, 267, 114/263, 344; 405/218–221

[56] References Cited

U.S. PATENT DOCUMENTS

| | | | |
|---|---|---|---|
| 2,336,140 | 12/1943 | Vogler | 61/48 |
| 2,829,390 | 4/1958 | Nolaro | 14/72 |
| 3,283,517 | 11/1966 | Phillips | 61/48 |
| 3,333,861 | 8/1967 | Hoffman | 114/344 |
| 3,380,257 | 4/1968 | Gillman | 61/48 |
| 3,744,072 | 7/1973 | Pannell et al. | 114/344 |
| 4,037,420 | 7/1977 | Wicks | 61/48 |
| 4,243,239 | 1/1981 | Whitney | 280/47.13 |
| 4,248,287 | 2/1981 | Christman | 152/354 |
| 4,480,578 | 1/1984 | Fisher et al. | 114/344 |
| 4,804,298 | 2/1989 | Nasby | 405/218 |
| 5,065,468 | 11/1991 | Sherrod | 14/72.5 |
| 5,158,032 | 10/1992 | Pitt | 114/263 |

FOREIGN PATENT DOCUMENTS

| | | | |
|---|---|---|---|
| 9109769 | 7/1991 | WIPO | 114/344 |

*Primary Examiner*—Edwin L. Swinehart
*Attorney, Agent, or Firm*—Jacobson & Johnson

[57] ABSTRACT

An apparatus for attachment to a dock to permit a person to take a dock in or out of the water including a pair of cylindrical flotation members, the cylindrical flotation members having sufficient buoyancy to support a water end of a dock with a person thereon, each of the cylindrical flotation members having extensions for positioning the flotation members laterally on opposite sides of a dock, the flotation members pivotable from a non-dock supporting position to a dock-supporting position, each of the cylindrical floatation members having sufficient diameter to enable the cylindrical flotation members to roll over land like a wheel.

19 Claims, 4 Drawing Sheets

PORTABLE DOCKS

FIELD OF THE INVENTION

This invention relates generally to boat docks, and, more specifically, a mechanism and method which permits one person to remove or install the boat dock.

1. Background of the Invention

The art is replete with different types of dock attachment devices to enable a person to take a boat dock in and out of the water. Some of the prior art devices use flotation devices that have sufficient buoyancy to support the dock when the flotation device is in the water can also be used as wheel when the dock is moved on land. One of the difficulties of such prior-art devices is that either they are cumbersome or they require one to get into the water to remove or install the flotation members. In colder climates, installing or removing a flotation device while standing in water renders one very uncomfortable.

The present invention provides a method wherein a set of lightweight flotation members can be used as wheels to roll the dock on land and can be used as floats to move the dock in and out of the water with the flotation members being installed laterally of the dock to permit installation and removal of the flotation members while standing on the dock. In addition the arrangement of the flotation members allows the person to use his or her weight to assist in transferring the weight from the dock posts to the flotation members or vice versa.

2. Brief Description of the Prior Art

U.S. Pat. No. 4,037,420 shows a dock with a flotation member which is temporarily mounted beneath the dock as the dock is rolled out into the water. Once the dock is installed, a drum has to be pushed down into the water to be removed from underneath the dock.

U.S. Pat. No. 4,243,239 shows a catamaran dolly for placing under a catamaran and moving the unit out of the water.

U.S. Pat. No. 4,248,287 shows a method of making a flotation-type tire.

U.S. Pat. No. 4,804,298 shows a dock which is hinged to a reinforcing structure which uses a wheel to support the free end of the dock.

U.S. Pat. No. 5,158,032 shows a dock dolly which a winch to enable lifting and removing the dock from the lake.

U.S. Pat. No. 2,829,390 shows a portable loading dock plate with a pivotal member for raising and lowering the dock plate.

U.S. Pat. No. 5,065,468 shows another portable dock with a pivotal member for raising and lowering the docking plate.

U.S. Pat. No. 2,336,140 shows a shipping dock which has a pivotal mount for accommodating variable water levels.

U.S. Pat. No. 3,283,517 shows a floating, movable dock in which a pair of flotation members are used to support the free end of the dock with the flotation members located beneath the dock.

U.S. Pat. No. 3,380,057 shows a portable dock supported by a wheel.

SUMMARY OF THE INVENTION

Briefly, the invention comprises an apparatus and method for attachment to a dock to permit a person to take a dock in or out of the water without having to get wet including a pair of wheel-like cylindrical flotation members, the cylindrical flotation members having sufficient buoyancy to support a water end of a dock with a person thereon, each of the cylindrical flotation members having extensions for positioning the flotation members laterally on opposite sides of a dock, the flotation members pivotable from a non-dock supporting position to a dock-supporting position, each of the cylindrical floatation members having sufficient diameter to enable the cylindrical flotation members to roll over land like a wheel.

DESCRIPTION OF THE PREFERRED EMBODIMENT

Figure 1:
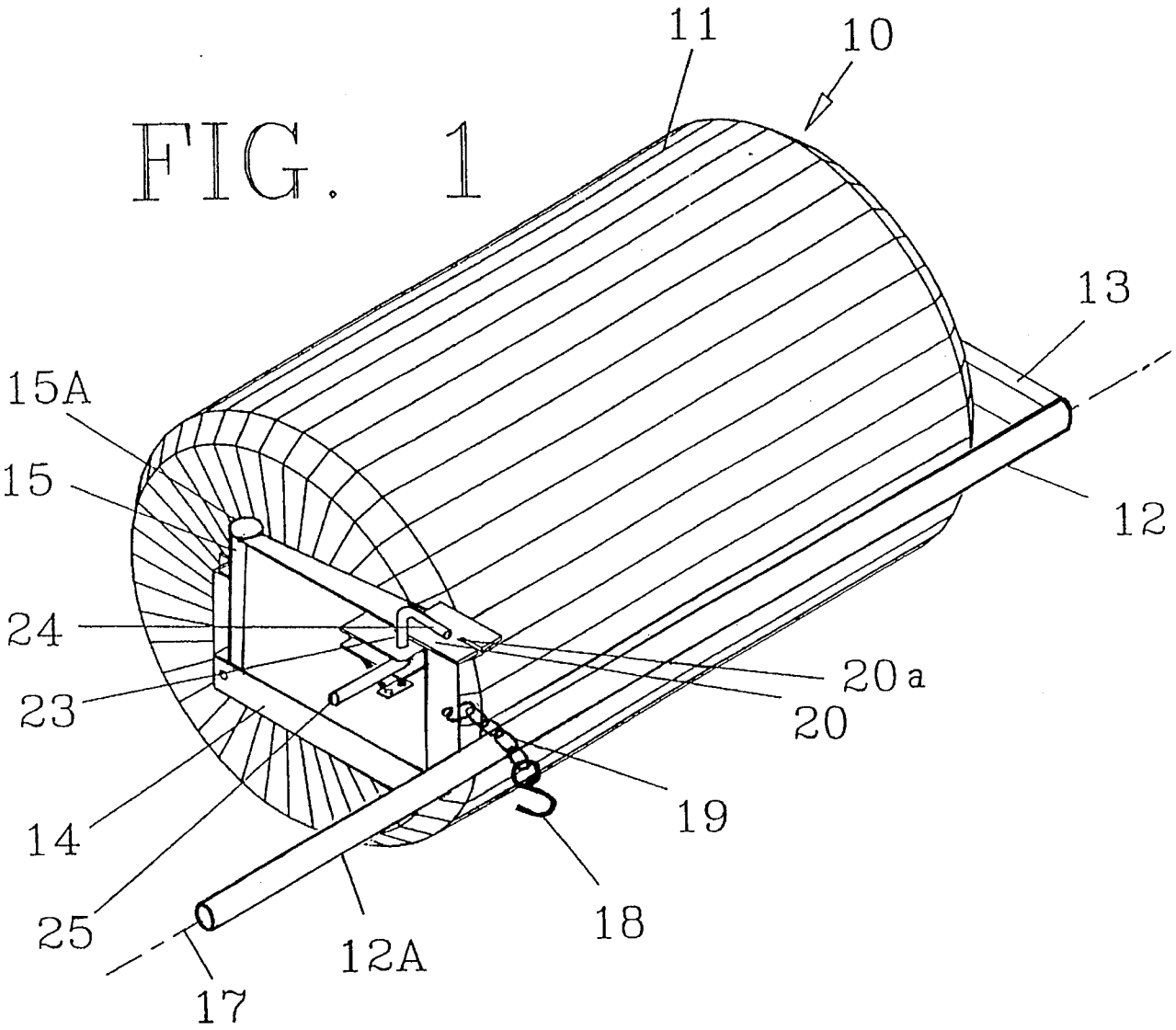
FIG. 1 shows a perspective view of a flotation wheel and pivotal support therefor.

FIG. 1 reference numeral 10 generally identifies a flotation member and support housing for temporary attachment to a dock that is to be taken in or out of the water. An elongated, wheel-like cylindrical flotation member 11 is pivotally supported on one end by a housing member 13 and on the other end by a housing member 14. Preferably, flotation member 11 is a barrel which is made of lightweight material, such as polyethylene or the like. Flotation member has a length of approximately four feet in width and approximately one to two feet in diameter. Although the length and diameter of the flotation member can vary in the present invention two flotation members are used which have sufficient buoyancy to support not only the water end of the dock but to support both the water end of the dock and the dock installer as the weight of the dock is transferred from the flotation members to the permanent dock posts.

Floatation member 10 includes a U-shaped frame comprised of housing members 12, 13 and 14 with housing members 13 and 14 forming radius arms and including rotatable support members (not shown) that attach to the ends of flotation barrel 11 to permit barrel 11 to roll like a wheel when the dock is moved over land. Housing 12 includes a cylindrical extension **12*a* that extends laterally outward of barrel 11 for engagement with a dock. Extension 12*a* has a cylindrical shape to enable one to pivotally and temporarily engage flotation member 10 with a cylindrical housing on a dock. Housing 14 includes a tubular member 15 which is off set from an axis 17 extending centrally through member 12 and 12*a*. Tubular member 15 includes an opening 15*a* therein for inserting a lever arm for pivoting flotation barrel about the central axis 17 extending longitudinally through member 12**.

Located on the top part of housing 14 is a holding plate 20 having a slot **20*a* therein for engagement with a chain for locking or holding barrel 11** into position for floating the dock or for rolling the dock on shore.

Located adjacent to plate 20 is a pivotal safety latch member 23 which has a lateral extension 25 for engaging the dock to prevent accidental pivoting of the member 11 during the raising or lowering of the dock. A chain 19 and a hook 18 permit temporary attachment of flotation member 10 to the dock to hold the flotation member in rotatable position laterally alongside the dock. Chain 19 is sufficiently long so as to permit substantial rotation of barrel about axis 17 but sufficiently short so as to prevent member 12*a* from accidentally slipping free of the dock during the raising and lowering of the dock.

Figure 2:
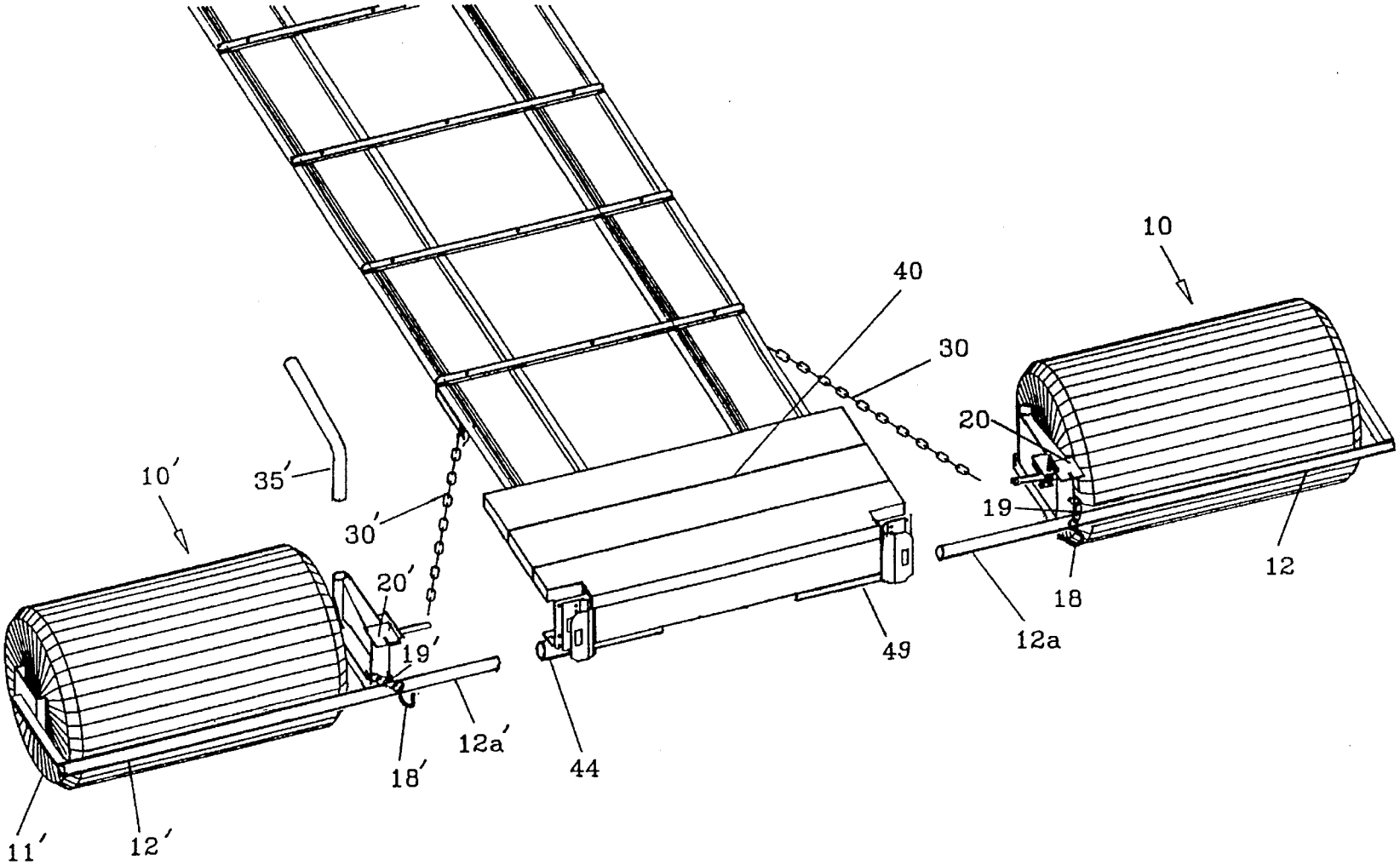
FIG. 2 shows an exploded view of a dock with two flotation wheels.

FIG. 2 reference numeral 10 identifies the flotation device on one side or dock 40 and similarly, reference numeral 10' identifies an identical but mirror image of floating dock member located on the opposite side of dock 40. Dock 40 is shown in a partial cutaway view revealing a first chain 30 attached to one one side of dock 40 and a second chain 30' attached to the other side of dock 40. Because flotation member 10 and 10' are identical except that one is the mirror image of the other the corresponding parts in flotation members are provided with identical identification except those in flotation member 10' are identified with a ' next to the number. The purpose of having two flotation members is that enables each to partially support the water end of dock 40 and it also permits installation of the flotation members laterally rather than beneath the dock 40.

Located on the underside of dock 40 is a first tubular member 44 and a second tubular member 49. Tubular member 49 is positioned so that extension member 12*a* can be inserted therein, and similarly, extension 12*a'* can be inserted in member 44. First tubular member 44 and 49 are positioned at a slight angle of 10 to 15 degrees below the horizon. By having the tubular members 44 and 49 positioned at a slight angle it allows for flexing of housing members 12 and 12*a'* so that barrels 11 and 11' remain substantially horizontal eventhough though the pressures on the lateral floating members is sufficient to bend members 12 and 12' Once members 12*a* and 12*a'* are inserted in there respective housings, chains 30 and 30' can be engaged to respectively to plates 30 and 30' after elevating the water end of dock 40 through use of a lever arm 35'. That is by pushing down on arm 35' the barrel 11' can be pivoted downward to support the dock on either land or water. To understand the lifting and coaction of the various members of the dock, reference should be made to FIG. 3.

Figure 3:
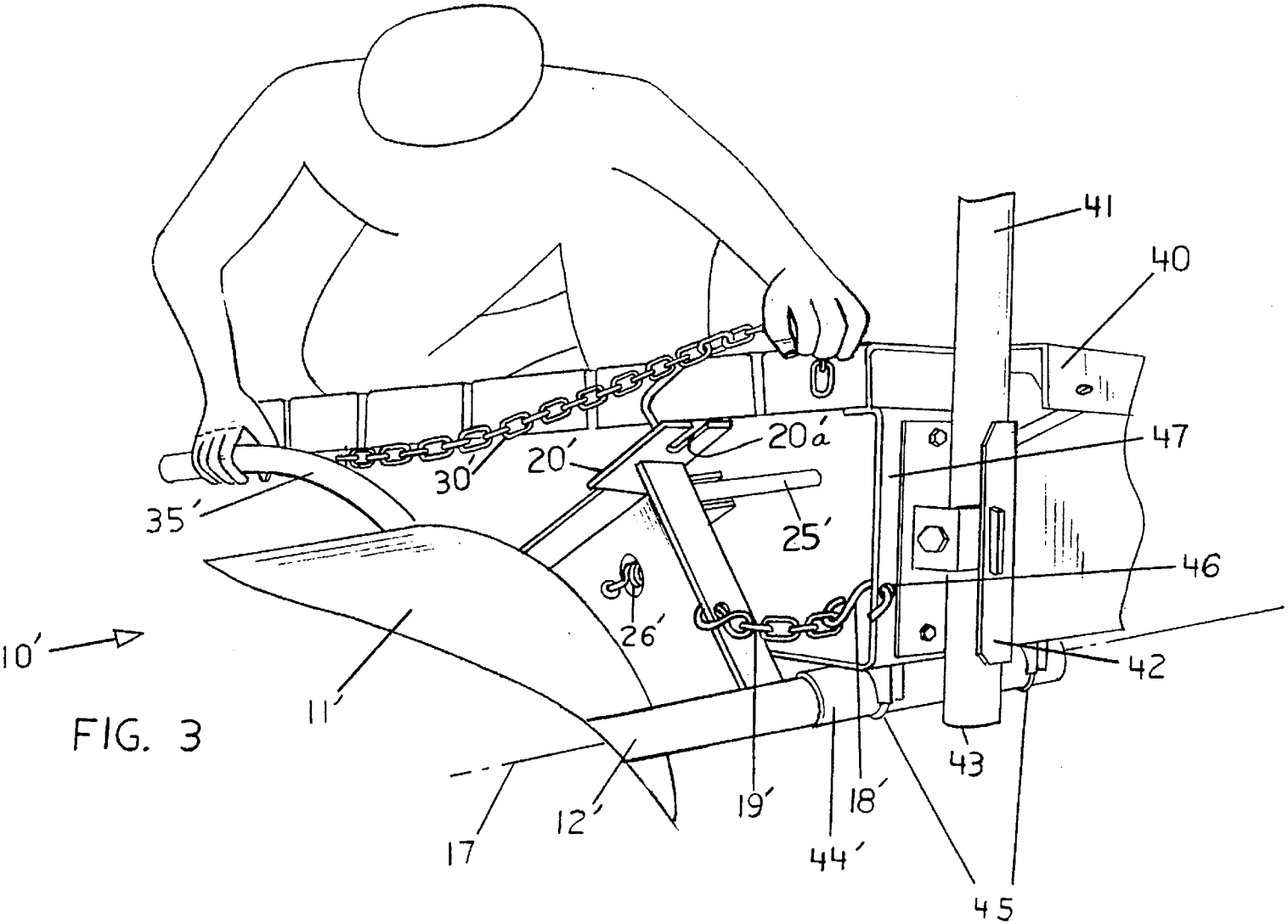
FIG. 3 shows the pivotal support member with the dock.

FIG. 3 shows dock 40 having a front plate 47 with a hook hole 46 therein. Also located on dock 40 is a dock bracket 42 and a dock post 43 for permanently supporting the water end of the dock once the dock is over the water. Located underneath the dock is tubular housing 44, secured to dock 40 by U-bolts 45. The tubular housing has a cylindrical opening therein for receiving and forming pivotable relationship with extension member 12' to enable pivotal mounting of flotation member 10' thereon. Chain 19' is shown with hook 18' engaging hook hole 46 to prevent accidental lateral displacement of flotation member 10' with respect to dock 40.

One of the features of the present invention is that the users own weight can be used to raise or lower the water end of the dock. FIG. 3 shows a person located on the dock transferring a portion of his or her own weight from dock 40 to lever arm 35' which cause flotation member to pivot about axis 17 extending through extension 12' The pivoting of flotation member 10' by a person on the dock 40 pushes flotation member 11' downward into the water until the weight of the dock and the person are supported by flotation member 10' Once the flotation member 10' supports one side of dock 40 the operator places a link of chain 30' into slot 20'*a* in plate 20' to hold the flotation member 10' in the dock transporting position. The use of chain 30' with multiple links permits one to position member 11' at various position according to the desire of the operator. The feature of raising or lowering the water end of the dock from a non-dock support position to a dock-support position can best be shown in reference to FIGS. 2, and 4–7.

Figure 4:
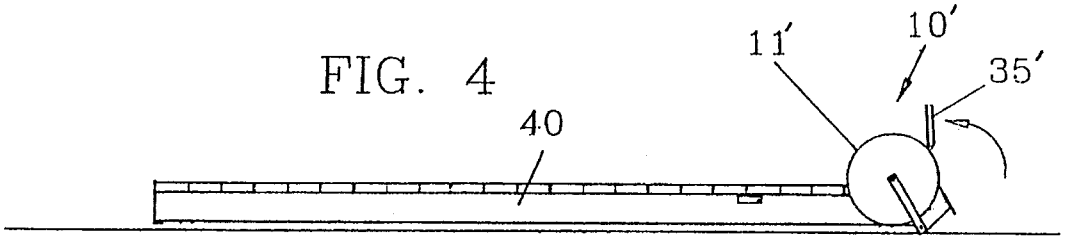
FIG. 4 shows a side view of the dock with a flotation wheel mounted thereon.

FIGS. 2 and FIGS. 4–7 illustrate the operation of the invention with respect to dock 40. In the first position (shown in FIG. 2) dock 40 flotation members 10' and 10 are being installed laterally from opposite sides dock 40 by inserting extension 12*a* in housing 49 and extension 12*a'* in housing 44. FIG. 4 shows that both flotation member 10 and flotation member 10' are installed laterally of dock 40 with dock 40 on the ground. That is, one does not have to lift up dock 40 to insert members 12*a* in housings 44 and member 12*a'* in housing 49.

Figure 5:
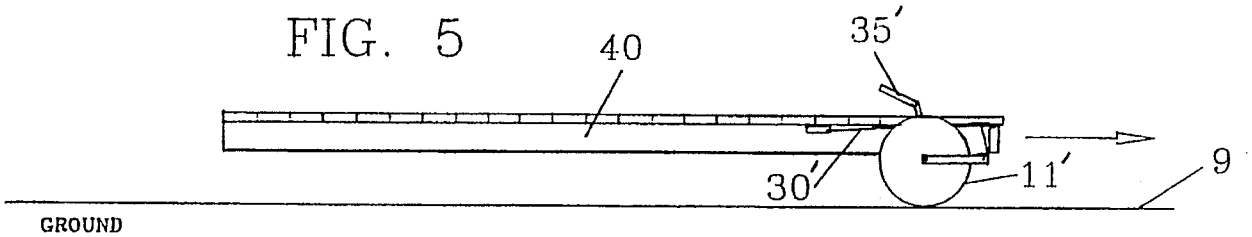
FIG. 5 shows the elevation of the dock through the use of the flotation wheel.
Figure 6:
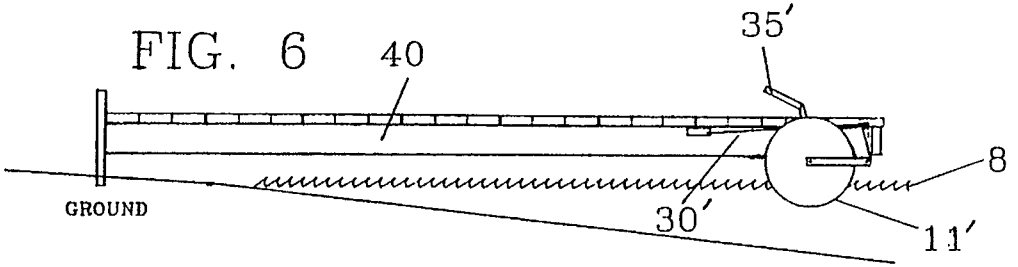
FIG. 6 shows the dock located in the water.

To illustrate the raising of dock 40 from a non-dock supporting position to a dock supporting position, where dock 40 can be taken in or out of the water by one person reference should be made to FIGS. 4–7. FIG. 4 and FIG. 5 show counterclockwise rotation of flotation member 10'. That is by pressing on lever arm 35' one pivot barrel about housing 12*a'* to raises the water end of dock 40 from ground 9. In the raised condition barrel 11' forms a wheel for rolling dock 40 over land. While only flotation member 10' is shown in FIGS. 4–7 the opposite counterpart flotation member 10 similar is used to raised the opposite side of dock 40. FIG. 5 shows that one end of chain 30' has been fastened to dock 40 and the other end of chain 30' to hold barrel 11' in the position shown in the dock supporting position shown in FIG. 5. With barrel 11' and 11 in the dock supporting position the dock 40 can be rolled over land and floated in water until the dock is properly positioned. FIG. 6 shows dock 40 extending over water 8 with the water end of dock supported by flotation member 11' and 11.

Figure 7:
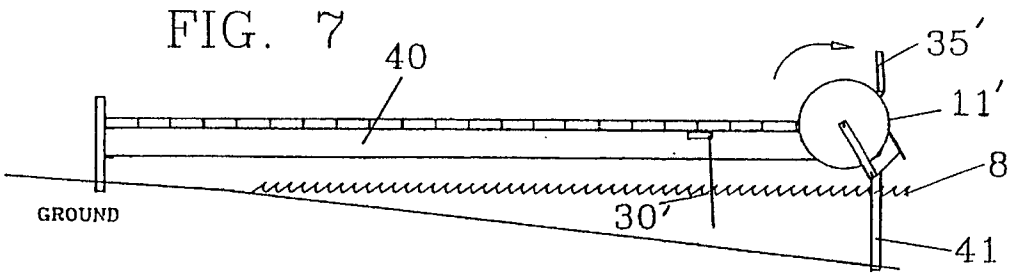
FIG. 7 shows the flotation wheel being removed from the dock.

With the water end of dock 40 supported by flotation members 10' and 10 a person can walk out onto dock 40 and install dock posts 41 from the deck on dock 40. That is, one can placed dock posts 41 in position to support the water end of dock 40. Once the dock posts 41 are in position, the person gets onto the water end of dock 40, pushes down slightly on arm 35' sufficiently to enable unlatching of chains 30 and 30' from the flotation member 11 and 11'. The barrels 11 and 11' can than rotated clockwise as shown in FIG. 7 to enable one to remove the barrels from the water. That is, by unhooking chains 19' and its counter part chain 19 from the dock 44 one can slide or float flotation members free of dock 44 without having to get into the water. One can than float barrels 11 and 11' to shore to enable one to place the dock over the water without the person having to get wet. To remove the dock from the water the opposite procedure is followed.

I claim:

1. An apparatus for installation and removal of a dock from a body of water comprising:

a first flotation wheel, said flotation wheel having a sufficient diameter to function as a first wheel for the dock when on land and sufficient buoyancy to function as a first float to floatingly support one end of the dock;

a first pivotal member having one end suitable for pivotal engagement with a first housing on a dock and a second end with a first radius arm for rotationally supporting the flotation wheel to permit the first flotation wheel to roll over terrain while supporting the one end of the dock;

a first leveling arm for engaging said first radius arm, said first leveling arm pivotally downward by a person standing on the dock to permit the transfer of a portion of the weight of the person on the dock to the first leveling arm to pivot said first flotatin wheel thereby enabling the first flotation wheel to raise the dock;

a second flotation wheel, said second flotation wheel having sufficient diameter to function as a second wheel for the dock when on land and sufficient buoyancy to function as a second float to floatingly support the one end of the dock;

a second pivotal member having one end suitable for pivotal engagement with a second housing on a dock and a second end having a second radius arm for rotationally supporting the flotation to wheel to permit the flotation wheel to roll over terrain, said second radius arm operable for pivoting downward by a person standing on the dock to permit the transfer of a portion of the weight of the person on the dock to the second radius arm to enable the flotation wheel to raise the dock.

2. The apparatus of claim 1 wherein the flotation wheels comprise polymer plastic barrels.

3. The apparatus of claim 1 including a chain to hold the flotation members proximate the side of the dock as the dock is taken in or out of the water.

4. The apparatus of claim 1 wherein the flotation wheels comprise polyethylene barrels.

5. The apparatus of claim 1 including chains for holding the first flotation wheel and the second flotation wheel in a dock supporting position.

6. The apparatus of claim 5 including a safety latch to prevent the cylindrical flotation members from accidently releasing.

7. The apparatus of claim 6 wherein said polymer plastic barrels are made of polyethylene.

8. The apparatus of claim 7 including a removable lever arm for engagement with the first flotation wheel to pivot the first flotation wheel from a non-dock supporting position to a dock supporting position.

9. The apparatus of claim 1 including a U-shaped housing for supporting each of said cylindrical flotation members with each having holding plates attached to each of said U-shaped housings to hold said flotation members in a dock-supporting position.

10. An apparatus for temporary attachment to a dock to permit a person to take a dock in or out of the water comprising:

a pair of cylindrical flotation members, said cylindrical flotation members having sufficient buoyancy to support a water end of a dock with a person thereon, each of said cylindrical flotation members having extensions for positioning the flotation members laterally on opposite sides of a dock, said flotation members pivotable from a non-dock supporting position to a dock-supporting position, each of said cylindrical floatation members having sufficient diameter to enable the cylindrical flotation members to roll over land like a wheel; and a removable lever arm for engagement with the flotation members to pivot the flotation members from a non-dock supporting position to a dock supporting position.

11. The apparatus of claim 10 including a safety latch to prevent the cylindrical flotation members from accidently releasing.

12. The apparatus of claim 10 wherein said cylindrical flotation members include polymer plastic barrels.

13. The apparatus of claim 12 wherein said polymer plastic barrels are made of polyethylene.

14. The apparatus of claim 10 including a U-shaped housing for supporting each of said cylindrical flotation members.

15. The apparatus of claim 14 including holding plates attached to each of said U-shaped housings to hold said flotation members in a dock-supporting position.

16. The apparatus of claim 15 including a slot in each of the holding plates for engaging links of a support chain.

17. An apparatus for temporary attachment to a dock to permit a person to take a dock in or out of the water comprising:

a pair of cylindrical flotation members, said cylindrical flotation members having sufficient buoyancy to support a water end of a dock with a person thereon, each of said cylindrical flotation members having extensions for positioning the flotation members laterally on opposite sides of a dock, said flotation members pivotable from a non-dock supporting position to a dock-supporting position, each of said cylindrical floatation members having sufficient diameter to enable the cylindrical flotation members to roll over land like a wheel; and a mechanical member for holding the cylindrical flotation members in a dock supporting position.

18. An apparatus for temporary attachment to a dock to permit a person to take a dock in or out of the water comprising:

a pair of cylindrical flotation members, said cylindrical flotation members having sufficient buoyancy to support a water end of a dock with a person thereon, each of said cylindrical flotation members having extensions for positioning the flotation members laterally on opposite sides of a dock, said flotation members pivotable from a non-dock supporting position to a dock-supporting position, each of said cylindrical floatation members having sufficient diameter to enable the cylindrical flotation members to roll over land like a wheel; and chains for holding the cylindrical flotation members in pivotal engagement with a dock housing.

19. The method of moving a dock from a position on land to a position over a body of water comprising the steps of:

placing a pair of flotation members in a pivotable position laterally of the dock;

pivoting the flotation members to raise one end of the dock to a dock support position where the floating members can be used to roll the dock over land and onto the body of water;

securing the floating members to hold the dock in the dock-supporting position during transfer of the dock from the land to the body of water;

moving the dock with the flotation members from land to water until the one end of the dock is supported by the flotation members;

attaching dockposts to the dock to support the one end of the dock;

pivoting the flotation members until the flotation members are free of the water; and sliding the flotation members laterally free of the dock to leave the dock supported solely by the dock posts.

* * * * *